US009580244B2

(12) United States Patent
Reeb et al.

(10) Patent No.: US 9,580,244 B2
(45) Date of Patent: Feb. 28, 2017

(54) LOCKING DEVICE FOR A CONTAINER

(71) Applicant: SERIO-US INDUSTRIES, INC., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 0 days.

(21) Appl. No.: 14/963,499

(22) Filed: Dec. 9, 2015

(65) Prior Publication Data

US 2016/0159570 A1 Jun. 9, 2016

Related U.S. Application Data

(60) Provisional application No. 62/104,303, filed on Jan. 16, 2015, provisional application No. 62/089,599, filed on Dec. 9, 2014.

(51) Int. Cl.

| | |
|---|---|
| ***B65F 1/16*** | (2006.01) |
| ***E05C 3/12*** | (2006.01) |
| ***E05C 3/16*** | (2006.01) |
| ***E05B 65/00*** | (2006.01) |
| ***B65F 1/14*** | (2006.01) |
| ***E05B 15/00*** | (2006.01) |

(52) U.S. Cl.

CPC ..... *B65F 1/1615* (2013.01); *E05B 15/0093* (2013.01); *E05B 65/006* (2013.01); *E05C 3/12* (2013.01); *E05C 3/16* (2013.01)

(58) Field of Classification Search

CPC ..... B65F 1/163; B65F 1/1615; B65F 1/16; B65F 1/1623; B65D 45/16; B65D 45/22; B65D 43/26; B65D 43/164; B65D 43/16; E05B 15/0093; E05B 65/006; E05C 3/12; E05C 3/16

USPC ..... 220/324, 315, 326, 264, 263, 262, 908, 220/827, 830, 810; 70/208, 207, 224

See application file for complete search history.

(56) References Cited

U.S. PATENT DOCUMENTS

| | | | |
|---|---|---|---|
| 3,674,298 | A | 7/1972 | Vekony |
| 5,224,744 | A | 7/1993 | Michelutti |
| 5,415,314 | A | 5/1995 | McCollum |
| 5,419,598 | A | 5/1995 | Kreitzer |
| 5,599,050 | A | 2/1997 | Tinsley |
| 5,772,061 | A | 6/1998 | Lowe |
| 5,772,264 | A | 6/1998 | Bettenhausen |
| 6,666,485 | B1 | 12/2003 | Moret |
| 6,808,080 | B2 | 10/2004 | Spiers et al. |
| 6,902,081 | B2 | 6/2005 | Walker |
| 8,485,382 | B2 | 7/2013 | Raghunathan et al. |
| 8,810,361 | B2 | 8/2014 | Thukral et al. |

(Continued)

FOREIGN PATENT DOCUMENTS

| | | |
|---|---|---|
| DE | 102007039351 | 11/2008 |
| EP | 2769933 | 8/2014 |
| WO | WO2014117102 | 7/2014 |

*Primary Examiner* — Robert J Hicks

(74) *Attorney, Agent, or Firm* — Berenato & White, LLC

(57) ABSTRACT

A locking device is provided, preferably for a container. The locking device keeps the lid of the container closed when the container is knocked over on its side, with a sudden jerking or jarring motion, such as by impact with the ground, to prevent spillage of its contents. The locking device, however, allows the lid to open when the waste container is tipped over, preferably in a forward direction, by a dumping operation.

20 Claims, 16 Drawing Sheets

(56) References Cited

U.S. PATENT DOCUMENTS

| | | | |
|---|---|---|---|
| 2004/0065666 | A1 | 4/2004 | Walker |
| 2005/0023839 | A1 | 2/2005 | Franich |
| 2005/0061824 | A1 | 3/2005 | Miller et al. |
| 2008/0169289 | A1 | 7/2008 | Dawn |
| 2010/0102575 | A1 | 4/2010 | Ferkovich et al. |
| 2012/0273495 | A1 | 11/2012 | D'Alessandro |
| 2014/0069926 | A1 | 3/2014 | Michael et al. |
| 2014/0238990 | A1 | 8/2014 | Banik et al. |

LOCKING DEVICE FOR A CONTAINER

CROSS-REFERENCE TO RELATED APPLICATIONS AND CLAIM TO PRIORITY

This application claims the priority of U.S. Provisional Patent Application No. 62/089,599, filed Dec. 9, 2014, and U.S. Provisional Patent Application No. 62/104,303, filed Jan. 16, 2015, the entire disclosures of which are incorporated herein by reference and to which priority is claimed.

FIELD OF THE INVENTION

The present invention generally relates to locking devices and, more particularly, relates to a locking device for a container, e.g. a waste container.

BACKGROUND OF THE INVENTION

Household refuse such as trash, recycling items, and/or yard waste can be deposited in a container. Such containers can include a lid for concealing the household refuse collected therein, as well as to prevent wild animals or people from accessing the household refuse and also protecting the content of the containers from the elements. Typically, the lid can be removably coupled to the container in a friction-fit manner to allow the lid to be easily removed from the container. However, when the lid is not secured, the contents can be undesirably expelled from the container.

Various lid locking devices have been implemented for refuse containers. For example, a strap can be coupled to the lid and the container in a snap lock fashion. However, this locking method requires a plurality of steps to secure the strap and the strap can easily become separated from the container. Another exemplary locking device includes a metal coil coupled between the lid and the container to provide great tension holding the lid in place. However, the coil can deteriorate due to exposure to the elements.

Therefore a need exists for a locking device that improves upon prior locking devices and solves problems inherent in known locking devices.

SUMMARY OF THE INVENTION

The present invention provides a locking device, e.g. for a container, that keeps the lid of the container closed when the container is knocked over on its side, with a sudden jerking or jarring motion, such as by impact with the ground, to prevent spillage of its contents. The locking device, however, allows the lid to open when the waste container is tipped over, preferably in a forward direction, by a dumping operation.

According to an aspect of the present invention, the locking device, which may be mounted on the container, contains a moveable locking block and at least one paddle. The locking block is movable between a locked position and an unlocked position. The at least one paddle has two opposing ends. A first end is mounted on a hinge to allow the paddle to pivot thereon. A second end of the paddle is detachably mounted to a mounting surface, preferably by magnetic attraction, such that a sudden jerking or jarring motion, such as by impact with the ground, causes the second end to detach from the mounting surface to block the locking block from moving from the locked position to the opened position. On the other hand, if the container is tipped over without impact, e.g. by being intentionally laid over by a user, the second end of the paddle remains attached to the mounting surface, which allows the locking block to be moved to an opened position. Essentially, the paddle provides a mechanical sensor that detects whether the container has been unintendedly tipped over or whether it is being intentionally laid over, such as for dumping.

According to a further aspect of the invention, a locking device is provided for a container. The locking device can include an arm configured to be removably coupled to a surface of the container. The arm is coupled to a rotatable shaft that extends through a housing of the locking device. A cam coupled to the rotatable shaft is disposed within the housing of the locking device. The cam is configured to rotate with the shaft. A first paddle and a second paddle are pivotably suspended from a paddle shaft within the housing of the locking device. A paddle actuation device has a lever extending outside the housing of the locking device, a shaft extending through an opening in a sidewall of the housing of the locking device, and a planar member coupled to the shaft. The planar member of the paddle actuation device is configured to actuate the first paddle when a force is applied to the lever of the paddle actuation device. A locking block has a channel, a first sloped surface associated with the first paddle, a second sloped surface associated with the second paddle, and a blocking device compartment. A magnetic device is mounted on a surface of the channel of the locking block opposite the second sloped surface. A blocking device has a cavity formed in a lower surface of the blocking device. The cavity is configured to receive a stoppage device. The blocking device is mounted to an inner surface of the housing of the locking device.

Other aspects of the invention, including apparatus, devices, systems, converters, processes, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION

Figure 1:
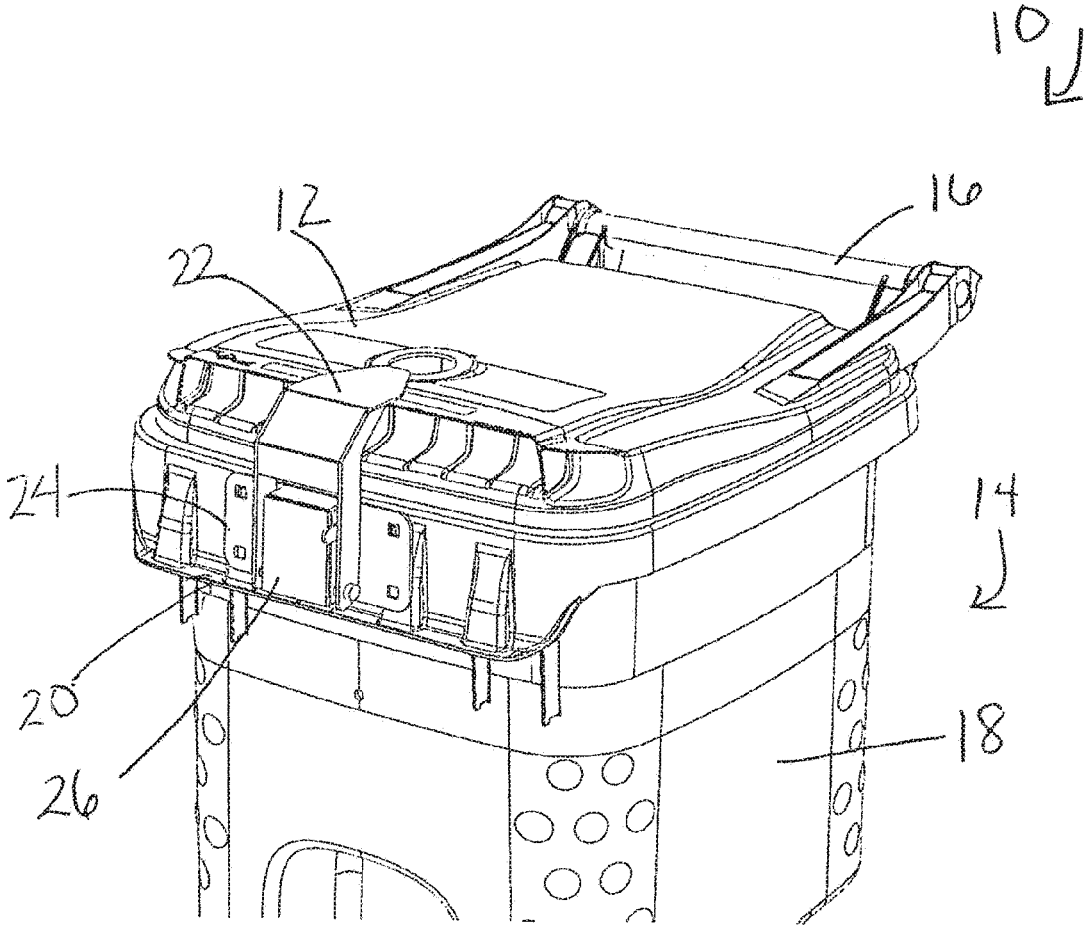
FIG. 1 is a fragmentary perspective view of a container with a locking device according to an exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" and "an" as used in the claims means "at least one" and the word "two" as used in the claims means "at least two".

As best shown in FIG. 1, a container 10 according to an exemplary embodiment of the present invention is illustrated. The container 10 may be a refuse container such as a household refuse container for various items including trash, recycling, and/or yard waste. However, container 10 may be used to accommodate any type of article. Container 10 may have any shape. For example, container 10 may be annular or polygonal. In addition, container 10 can be made of various materials such as plastic, metal, or a combination thereof.

Container 10 includes a lid 12 and a containment body 14. The containment body 14 defines an interior volume for holding, e.g., waste. The lid 12 can be separate from the containment body 14 or can be pivotally mounted to the containment body though coupling 16, such as a lid hinge. The containment body 14 may include a plurality of side walls 18. The lid 12 and the containment body 14 of container 10 may be made of the same or different materials. In an exemplary embodiment, wheels (not shown) may be coupled to the containment body to aid in transport of the container.

A locking device 20 is coupled to a portion of the container 10. For example, as illustrated in FIG. 1, locking device 20 may be mounted to a side wall 18 of the container 10 (preferably a front side wall opposite to the side wall where the coupling 16 is attached) where the locking arm 22 of the locking device 20 is removably coupled to a top surface of the lid 12 of the container 10. However, the locking device 20 can alternatively be mounted on the lid 12, where the locking arm 22 is removably coupled to a portion of a side wall 18 of the containment body 14.

When in a locked position, e.g. as illustrated in FIG. 1, the locking device 20 is configured to prevent access to the inside of the containment body 14. In an exemplary embodiment, the locking device 20 prevents the lid 12 from separating from the containment body 14 of the container and/or prevents the contents of the container 10 from being removed or expelled from the containment body 14. As best illustrated in FIG. 1, the locking device 20 is mounted to a side wall 18 of the container 10 using a mounting plate 24. The mounting plate 24 may be coupled to the container 10 using various methods such as adhesive, mechanical fasteners, such as screws, bolts, or the like. While the locking device 20 is illustrated as being formed separate from the container 10, one of ordinary skill in the art would appreciate that the locking device 20 may be manufactured integral with the container 10.

Locking device 20 includes a locking arm 22, a locking device housing 26, a rotatable shaft 28, a cam 30, a first paddle 32, a second paddle 34, a paddle actuation device 36, a locking block 38, a magnetic device 40, and a blocking device 96, as illustrated in FIGS. 2-8. The locking arm 22 comprises a planar portion 44 configured to contact an upper surface of the lid 12. While the locking arm 22 may have a shape as illustrated in FIGS. 1-8, one of ordinary skill in the art would recognize that the locking arm 22 can have any shape such that when the locking device 20 is in a locked position, the arm 22 prevents the lid 12 from separating from containment body 14, preferably from lifting upwardly and away from the containment body 14.

Figure 2:
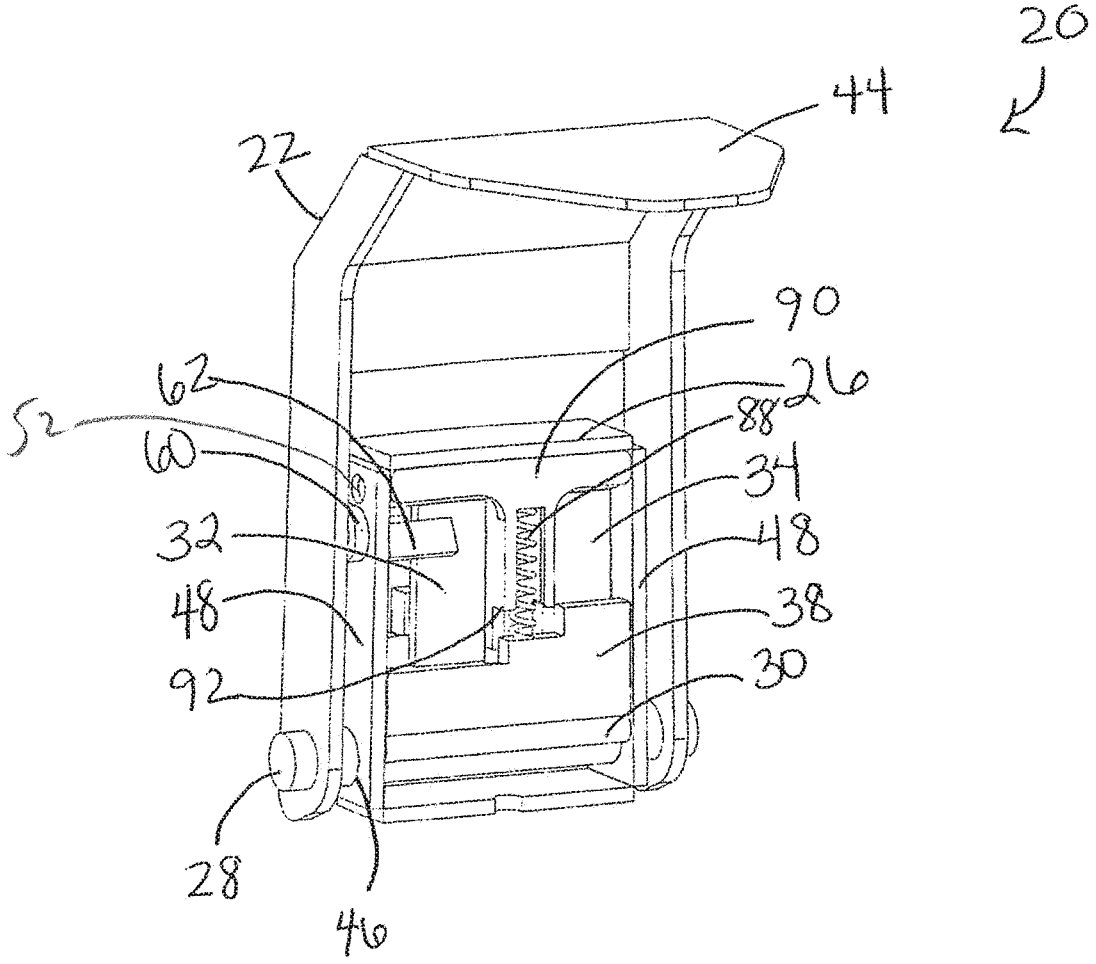
FIG. 2 is a first perspective view of the locking device according to an exemplary embodiment of the present invention.
Figure 3:
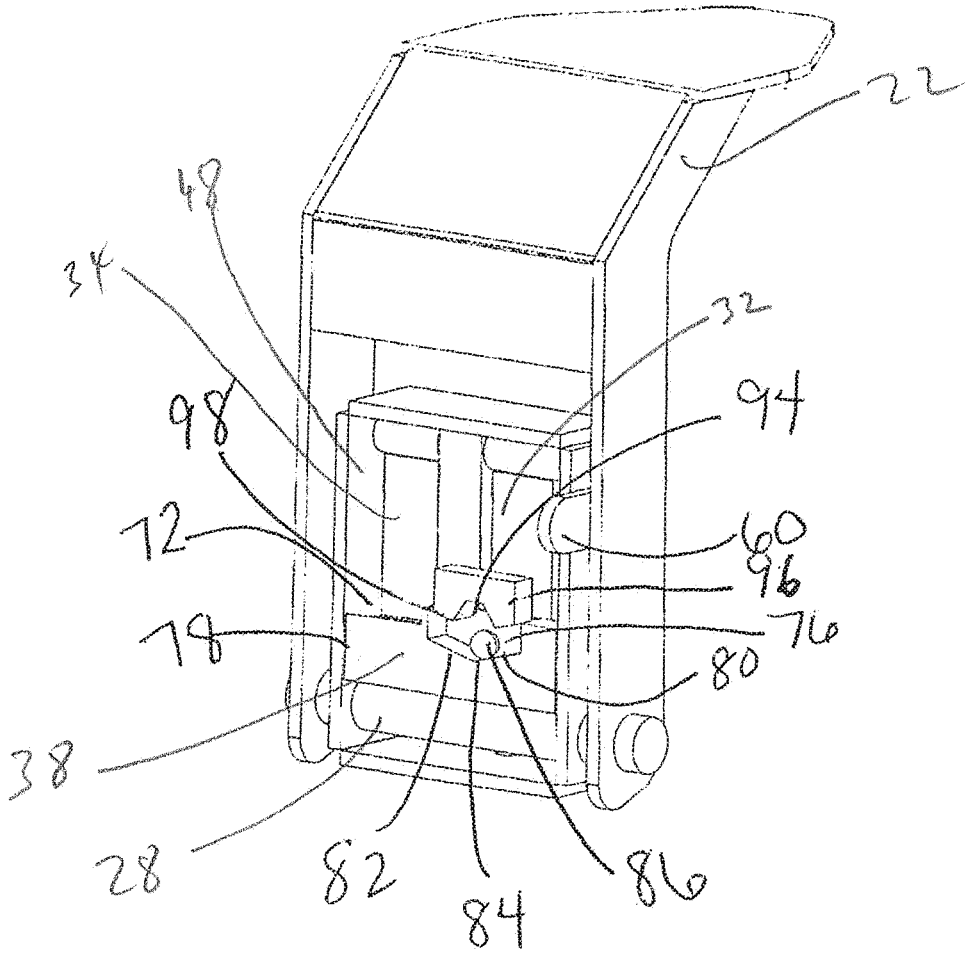
FIG. 3 is a second perspective view of the locking device according to an exemplary embodiment of the present invention.

In an exemplary embodiment, the locking arm 22 is a single unarticulated [?] structure, as best illustrated in FIGS. 2-3, where the planar portion 44 is integral with the portion of the locking arm 22 that is coupled to the rotatable shaft 28, such that when the locking arm 22 rotates around the axis of the rotatable shaft 28, the planar portion 44 has the same moment of inertia as the rest of the locking arm 22.

The locking arm 22 is coupled to the rotatable shaft 28. For example, the locking arm 22 can be permanently coupled to the shaft 28 such that when the locking arm 22 is actuated, the shaft 28 rotates about an axis. Alternatively, the locking arm 22 may be integrally formed with the rotatable shaft 28. The rotatable shaft 28 extends through an opening 46 formed in a sidewall 48 of the locking device housing 26.

Figure 4:
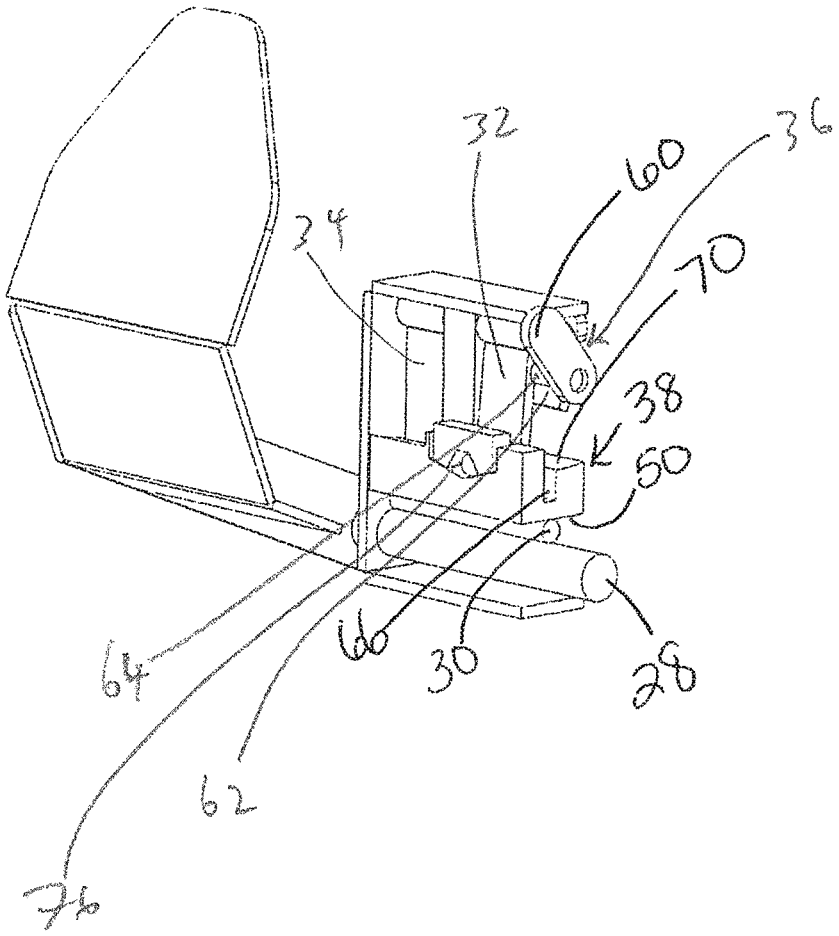
FIG. 4 is a perspective view of a locking device in an unlocked position according to an exemplary embodiment of the present invention.
Figure 5:
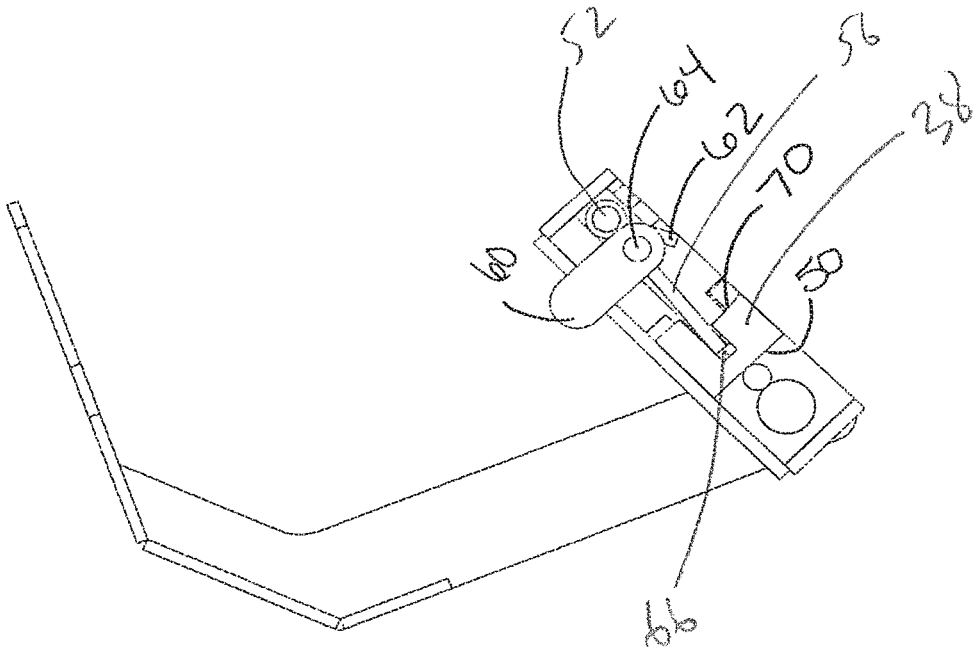
FIG. 5 is a cross-sectional view of the locking device in the unlocked position according to an exemplary embodiment of the present invention.
Figure 6:
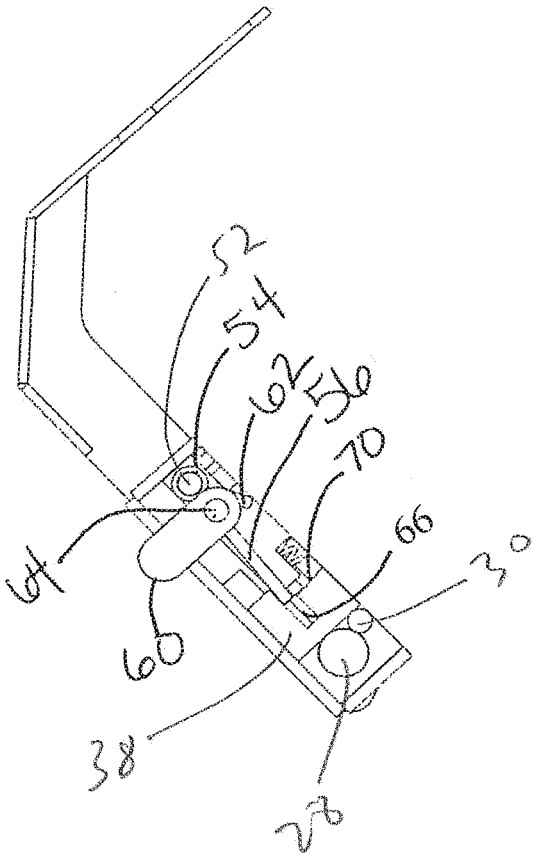
FIG. 6 is a cross-sectional view of the locking device according to an exemplary embodiment of the present invention.
Figure 7:
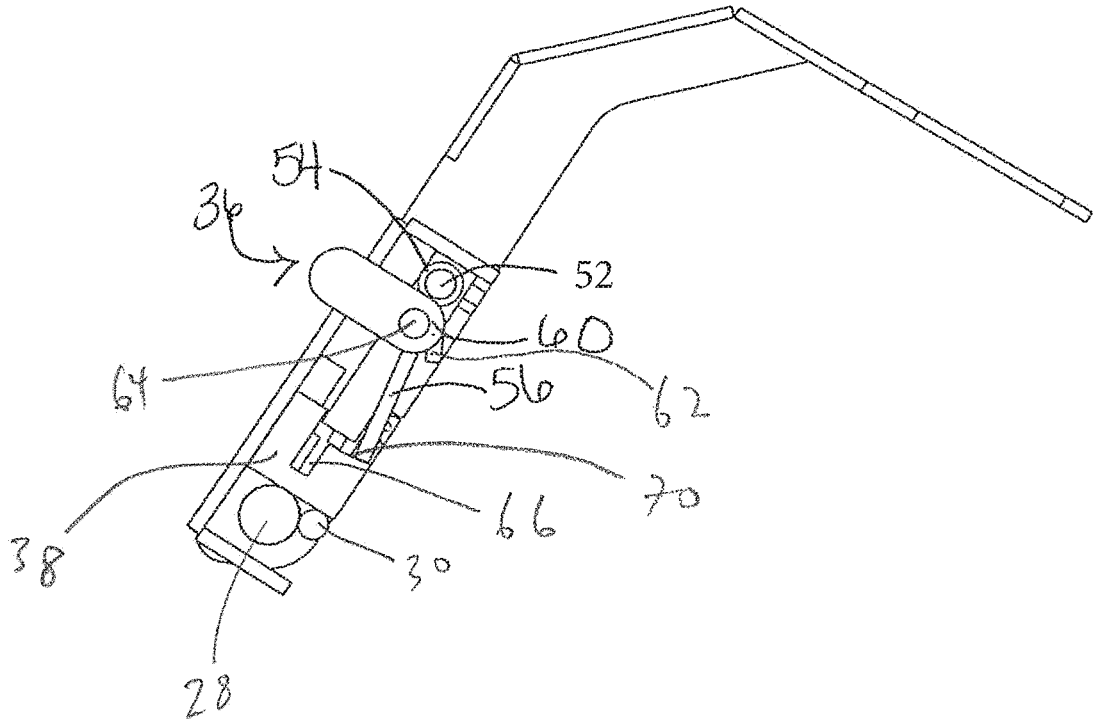
FIG. 7 is a cross-sectional view of the locking device according to an exemplary embodiment of the present invention.
Figure 8:
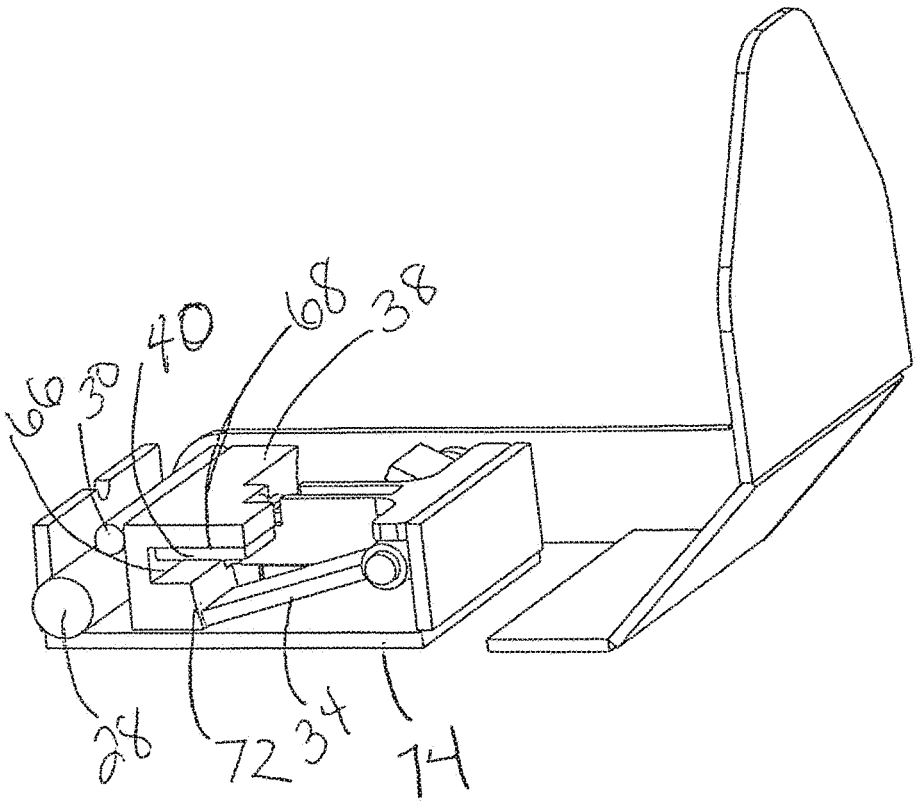
FIG. 8 is a perspective view of the locking device according to an exemplary embodiment of the present invention.

A cam 30 is fixedly coupled to the rotatable shaft 28 using any of various coupling techniques such as welding, adhesive, mechanical fasteners, etc. The cam 30 preferably is a cylinder having a center axis that is parallel to the center axis of the rotatable shaft 28, and coupled to the rotatable shaft 28, such that when the rotatable shaft 28 rotates on its center axis, the center axis of the cam 30 moves in an arc around the rotatable shaft 28. The cam 30 may be contained entirely within the locking device housing 26, so that the cam 30 does not extend through the sidewalls 48 of the locking device housing 26. The cam 30 contacts a lower surface 50 of the locking block 38 where the position of the cam 30 is based on the position of the arm 22 of the locking device 20. For example, when the locking arm 22 is in the locked position, the cam 30 is in a lateral position with respect to the rotatable shaft 28, as best illustrated in FIGS. 6-8. When the locking arm 22 is actuated and spaced away from the lid 12 of the container 10 (an opened position of the locking arm 22), the cam 30 is rotated into a vertical position such that the cam 30 is above the rotatable shaft 28, as best illustrated in FIGS. 4-5. It is noted that while the figures may illustrate that the cam 30 is in contact with the lower surface 50 of the locking block 38, the cam 30 can be coupled to the rotatable shaft 28 such that when the locking arm 22 is in the locked position, only the rotatable shaft 28 is in contact with the lower surface 50 of the locking block 38; and as the locking arm 22 is actuated, the cam 30 can rotate thereby coming into contact with the lower surface 50 of the locking block 38. Alternatively, a bias force may be applied to the locking block 38 such that the lower surface 50 of the locking block 38 does not touch the rotatable shaft 28.

At least one paddle may be mounted within the locking device housing 26. For example, a first paddle 32 and a second paddle 34 are rotatably suspended from a paddle shaft 52, such that the first and second paddles 32, 34 may pivot around the paddle shaft 52. The paddles 32,34 are preferably disposed adjacent to each other and extend in parallel. Each of the paddles 32, 34 has a sleeve portion 54 and a planar portion 56. The sleeve portion 54 surrounds the paddle shaft 52 and the planar portion 56 extends from the sleeve portion 54 such that the planar portion 56 can freely swing about the paddle shaft 52. The paddles 32, 34 may be made of various materials such as plastic, metal, etc, and may be made of the same material or different material. While two paddles 32, 34 are illustrated, only one paddle may be used. For example, only the first paddle 32 is used, while the second paddle is not; or conversely, only the second paddle is used.

A paddle actuation device 36 (FIG. 7) is configured to actuate the first paddle 32 from the suspended position such that the locking arm 22 can be actuated after a force is applied to the paddle actuation device 36. As best illustrated in FIG. 4, the paddle actuation device 36 includes a lever 60, a planar member 62, and a shaft 64 coupled between the lever 60 and the planar member 62. The lever 60 extends outside the housing 26 of the locking device 20 (as best shown in FIG. 3), such that a user can interact with the paddle actuation device 36. The shaft 64 extends through an opening formed in a sidewall 48 of the locking device housing 26 and translates the force applied on the lever 60 to the planar member 62. In an exemplary embodiment, the planar member 62 is arranged at an angle with respect to the first paddle 32 as best illustrated in FIGS. 2 and 5-8. In an exemplary embodiment, an opening (not illustrated) is formed in the lever 60 of the paddle actuation device 36 where a portion of a padlock or other locking mechanism is coupled to the container 10 through the opening. The paddle actuation device 36 is preferably located proximate to the first paddle 32.

A locking block 38 is configured to prevent the paddles 32, 34 from freely swinging under certain circumstances. As best illustrated in FIGS. 4-8, the locking block 38 includes a channel 66 formed in the length of the block 38, a first sloped surface 70, a second sloped surface 72, and a blocking device compartment 76. The depth of the channel 66 is such that the paddles may slide into the channel when the locking block 38 is lifted by the cam 30 when the locking arm 22 is in the opened position (as discussed in further detail below).

In an exemplary embodiment, the second paddle 34 may be made of a magnetic material and a magnetic device 40, e.g. as a magnet, may be mounted on an inner surface 68 of the channel 66 of the locking block 38, as best shown in FIG. 8. Specifically, the magnetic device 40 is mounted on the side of the channel 66 opposite to the side associated with the second sloped surface 72. The second paddle 34 is in magnetic contact with the magnetic device 40 unless a force greater than the magnetic force between the second paddle 34 and the magnetic device 40 acts upon the locking device 20. The magnitude of the magnetic force between the second paddle 34 and the magnetic device 40 may be modified based on the type and/or size of the selected magnetic device 40. For example, if it is desired that the paddle 34 and the magnetic device 40 separate when a small force acts upon the container 10, a magnetic device 40 having a smaller surface area and/or a material having weaker magnetic properties is selected to create a small magnetic force between the paddle 34 and the magnetic device 40. If it is desired that the paddle 34 and the magnetic device 40 separate only when a large force acts upon the container 10, a magnetic device 40 having a larger surface area and/or a material having stronger magnetic properties is selected to create a large magnetic force between the paddle 34 and the magnetic device 40.

The first sloped surface 70 and the second sloped surface 72 are formed in an upper surface of the locking block 38, as best shown in FIGS. 7-8. The first sloped surface 70 is associated with the first paddle 32; and the second sloped surface 72 is associated with the second paddle 34. In an exemplary embodiment, the first paddle 32 contacts the first sloped surface 70 when the container 10 is in the upright position, thereby preventing the locking block 38 from moving (sliding upwardly) even if a force is applied to the arm 22 of the locking device 20 (FIG. 7). When the lever 60 of the paddle actuation device 36 is actuated, e.g. by lifting the lever 60 upwardly, the planar member 62 contacts a surface of the paddle 32 causing the first paddle 32 to disengage from the first sloped surface 70 to align with the channel 66 of the locking block 38 (FIG. 6).

Also, when the when the container 10 is in the upright position and the arm 22 is in the locked position, the second paddle 34 is attached to the magnetic device 40 to align the second paddle 34 with the channel 66 of the locking block 38. Thus, when the first paddle 32 and the second paddle 34 are aligned with the channel 66, a user may actuate the arm 22 to put it into the opened position. Here, when the user pulls the locking arm 22 forwardly, away from the lid 12, the locking arm 22 rotates the shaft 28 around its axis, which in turn urges the cam 30 against the bottom surface 50 of the locking block 38 to push the locking block upwardly (FIG. 4). The locking block 38 is allowed to be pushed upwardly, because of the alignment of both the first and second paddles 32, 34 with the channel 66 of the locking block 38 (FIG. 5). The alignment allows paddles 32, 34 to slide into the channel 66 as the locking block 38 is pushed upwardly by the cam 30 upon actuation of the locking arm 22. Thus, when the container 10 is in an upright position, to open the container, a user must first actuate the lever 60 to put the first paddle 32 into alignment with the channel 66 of the lock block. Essentially, the first paddle 32 serves as a safety lock for the locking device 20.

The second paddle 34, when in its normal position, is attached to the magnetic device 40 and is in alignment with the channel 66. However, the second paddle 34 is placed in contact with the second sloped surface 72, when a force is applied to the container 10 such as when the container 10 experiences an impact and/or has been overturned where the front wall 74 of the locking device housing 26 is substantially parallel to the ground or other surface, as illustrated in FIG. 8. When the second paddle 34 is in contact with the second sloped surface 72, the locking arm 22 cannot be placed into the opened position, because the locking block 38 cannot be moved by the cam 30. Essentially, the second paddle 34 serves as a mechanical sensor that detects whether the container 10 has been unintendedly tipped over, in the forward direction, or whether it is being intentionally laid over, such as for dumping. Impact from an unintended forward fall of the container 10 dislodges the second paddle 34 from the magnetic device 40 to place it in the contact with the second sloped surface 72 to prevent the locking arm 22 from being placed into the opened position. On the other hand, if impact is not present, e.g. when the container 10 is intentionally laid forward on its front wall 74, the second paddle 34 remains attached to the magnetic device 40, which allows the locking arm 22 to be placed into the opened position when the first paddle 32 is in alignment with the channel 66 of the lock block.

In certain embodiments, the blocking device compartment 76 may be formed in a side wall 78 of the locking block 38. As illustrated in FIG. 3, the blocking device compartment 76 has a first angled surface 80 and a second angled surface 82 such that the first angled surface 80 and the second angled surface 82 meet at an apex 84. A stoppage device 86, such as a ball bearing, is provided in the blocking device compartment 76. When the container 10 is in the upright position, the stoppage device 86 rests within the blocking device compartment 76 near the apex 84 as illustrated in FIG. 3. However, when the container 10 is not in the upright position and on its side, the stoppage device 86 moves within the blocking device compartment 76 and comes to rest in a portion of the blocking device compartment 76 based on gravitational forces.

A blocking device 96 may be mounted to an inner surface of the housing 26 of the locking device 20. The blocking device 96 includes a cavity 94 formed in a lower surface of the blocking device 96 where the cavity 94 is configured to cooperate with the blocking device compartment 76 to receive and retain the stoppage device 86 between the blocking device compartment 76 and the cavity 94. When the container 10 is on its side, gravity pulls the stoppage device 86 toward the first angled surface 80 or the second angled surface 82 of the blocking device compartment 76. In those positions, the stoppage device 86, in cooperation with the blocking device 96, prevents the locking block 38 from being moved upwardly to place the locking arm 22 into the opened position. Thus, when retained between the blocking device compartment of the locking block 38 and the blacking device 96, the stoppage device 86 serves as a safety, preventing the locking arm from being put into the opened position when the container 10 is on either its sides.

In certain exemplary embodiments, the locking device 20 may further include a bias force device 88, such as a spring or coil, mounted within a bias force device block 90 (FIG. 2). The bias force device 88 extends beyond a lower surface 92 of the bias force device 88 to provide a bias force to the locking block 38. Specifically, the bias force device 88 contacts an upper surface of the locking block 38. As the rotatable shaft 28 is actuated and the cam 30 rotates, providing an upward force on the lower surface 50 of the locking block 38, causing the bias force device 88 to compress and the lower surface 92 of the bias force device block 90 to contact a portion of the upper surface the locking block 38. While a bias force device 88 is illustrated in the figures, one of ordinary skill in the art would recognize that the bias force device 88 and the bias force device block 90 may be omitted from the locking device 20.

In operation, when the container 10 is in an upright position and the locking device 20 is in a locked position, the locking arm 22 blocks the lid 12 of the container 10 from opening, the first paddle 32 is in contact with the first sloped surface 70 of the locking block 38, the second paddle 34 is in contact with the magnetic device 40, and the bias force device 88, if present, extends beyond the bias force device block 90 to contact the locking block 38. In order to open the container 10, the user applies a force to the paddle actuation device lever 60, causing the planar member 62 to interact with the first paddle 32 to disengage the first paddle 32 from the first sloping surface 70. The first paddle 32 is actuated to align with the channel 66 of the locking block 38. The locking arm 22 can then be actuated away from the top surface of the lid 12 of the container 10, causing the rotatable shaft 28 and cam 30 to rotate. As the rotatable shaft 28 and cam 30 rotate, the cam 30 contacts the lower surface 50 of the locking block 38 and causes the locking block 38 to move upwardly, while the first paddle 32 slides into the channel 66 of the locking block 38. The upward movement of the locking block 38 further causes the bias force device 88 to compress and lower surface 92 of the bias force device block 90 to contact the upper surface of the locking block 38. When the first paddle 32 is disposed within the channel 66 of the locking block 38, the locking device 20 is in the unlocked position. During this process, the second paddle 34 remains attached to the magnetic device, and thus also slides into the channel 66 of the locking block 38 as the locking block 38 moves upwardly.

To actuate the locking device 20 from the unlocked position to the locked position, a user places the lid 12 on the containment body 14 of the container 10 and locates the locking arm 22 over the top surface of the lid 12. As the locking arm 22 is rotated, the rotatable shaft 28 and cam 30 rotate away from the lower surface 50 of the locking block 38, allowing the bias force device 88 to extend beyond the lower surface 92 of the bias force device block 90. In addition, the first paddle 32 disengages from the channel 66 and moves freely due to gravity. The first paddle 32 then, due to gravity, swings to contact the first sloping surface 70 of the locking block 38.

It is noted that the second paddle 34 is in contact with the magnetic device 40 during the actuation between the locked and unlocked positioned when the container 10 is in the upright position.

After the locking device 20 is in the locked position, the locking device 20 will remain in the locked position even when the container 10 is not in the upright position. For example, when a force acts on the container 10 causing the container 10 to fall such that the side wall 18 in which the locking device 20 is mounted impacts the ground, the force of the impact disengages the second paddle 34 from the magnetic device 40. Gravity then swings the second paddle 34 to be in contact the second sloping surface 72. When the second paddle 34 is in contact with the second sloping surface 72, the locking block 38 is prevented from moving, thereby preventing the locking arm 22 from being put into the opened position (and thus preventing the cam 30 and the rotatable shaft 28 from rotating).

When the container 10 falls such that the side wall opposite to the side wall in which the locking device 20 is mounted contacts the ground, the magnetic force between the second paddle 34 and the magnetic device 40 keeps the second paddle aligned with the channel 66. However, when the container 10 lays in that position, gravity pulls on the first paddle 32 to put it into contact with the first sloping surface 70, thereby preventing the locking block 38 from moving which prevents the locking arm 22 from being put into the opened position (and thus preventing the cam 30 and the rotatable shaft 28 from rotating).

When the container 10 falls such that a side wall adjacent to the side wall in which the locking device 20 is mounted contacts the ground, the stoppage device 86 moves within the blocking device compartment 76 such that if the locking block 38 tries to move, the stoppage device 86 will contact a lower surface 98 of the blocking device 96 (e.g., not within the cavity 94) thereby preventing the locking block 38 from moving upward and the rotatable shaft 28 of the locking arm 22 from rotating.

The above described locking device 20 can provide the following advantages. For example, the paddles 32, 34 and/or blocking device 96 prevent the locking device 20 from unlocking when the container 10 is knocked over in any direction by natural forces or by animals/humans. In addition, due to pivotal suspension of the paddles 32, 34 from the paddle shaft 52, the paddles 32, 34 prevent the locking device 20 from unlocking when the container 10 is not in an upright position. When the container 10 is returned to the upright position, normal locking and unlocking procedures can be resumed without any additional resetting steps. No additional devices such as keys are needed to actuate the locking device 20, such that the container 10 can be locked and unlocked directly without any additional device. The locking device 20 prevents animals from accessing the container 10 yet allow for easy access by humans because the locking device 20 is unlocked by applying a force to the paddle actuation device 36 while rotating the locking arm 22. Moreover, the locking device 20 is mounted to an outside surface of the container 10, thereby separating the locking device 20 from the waste stream to prevent undesired deterioration.

FIGS. 9-15 illustrate another exemplary embodiment of a locking device 20. Locking device 20 includes many of the same elements described above including the rotatable shaft 28, the cam 30, the first paddle 32, the second paddle 34, the paddle actuation device 36, the locking block 38, the magnetic device 40, and the blocking device 96. However, locking arm 102, as illustrated in FIGS. 9-15, differs from locking arm 22 described above.

Figure 15:
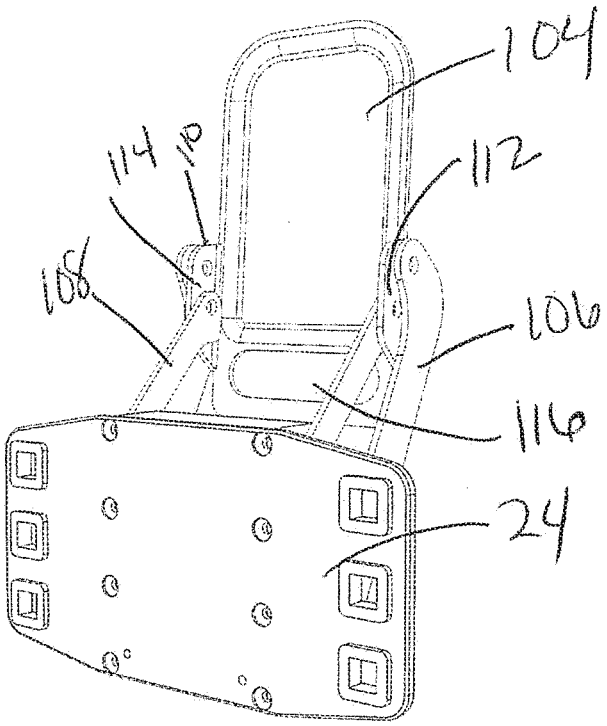
FIG. 15 is a rear perspective view of the locking device according to another exemplary embodiment of the present invention.

Specifically, locking arm 102 is an articulated body that includes a locking plate 104, a first locking shaft 106, and a second locking shaft 108. As best illustrated in FIG. 15, the locking plate 104 includes a mounting plate 110, where one end of the first locking shaft 106 and one end of the second locking shaft 108 are pivotably coupled to the mounting plate 110. Specifically, the first locking shaft 106 is pivotably coupled to an outer surface 112 of the mounting plate 110 and the second locking shaft 108 is pivotably coupled to an inner surface 114 of the mounting plate, as shown in FIG. 15. However, the first locking shaft 106 and the second locking shaft 108 can be pivotably coupled to the same surface (e.g., either the inner surface 114 or the outer surface 112). In certain embodiments, the locking plate 104 may further include an opening 116 formed at an edge of the locking plate 104. The other end of the first locking shaft 106 is connected to the rotatable shaft 28 in a similar manner as the locking arm 22. The other end of the second locking shaft 106 is mounted to the shaft 64.

Figure 9:
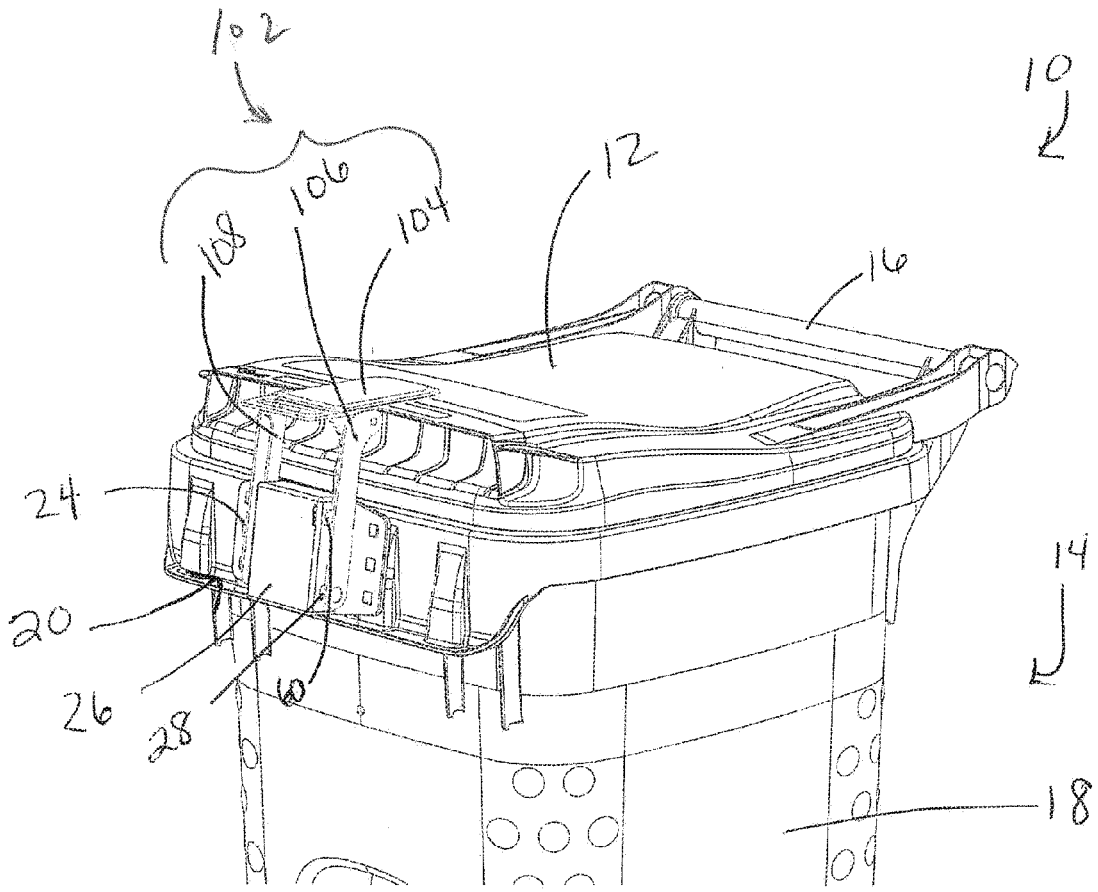
FIG. 9 is a fragmentary perspective view of a container with a locking device in a first position according to another exemplary embodiment of the present invention.
Figure 10:
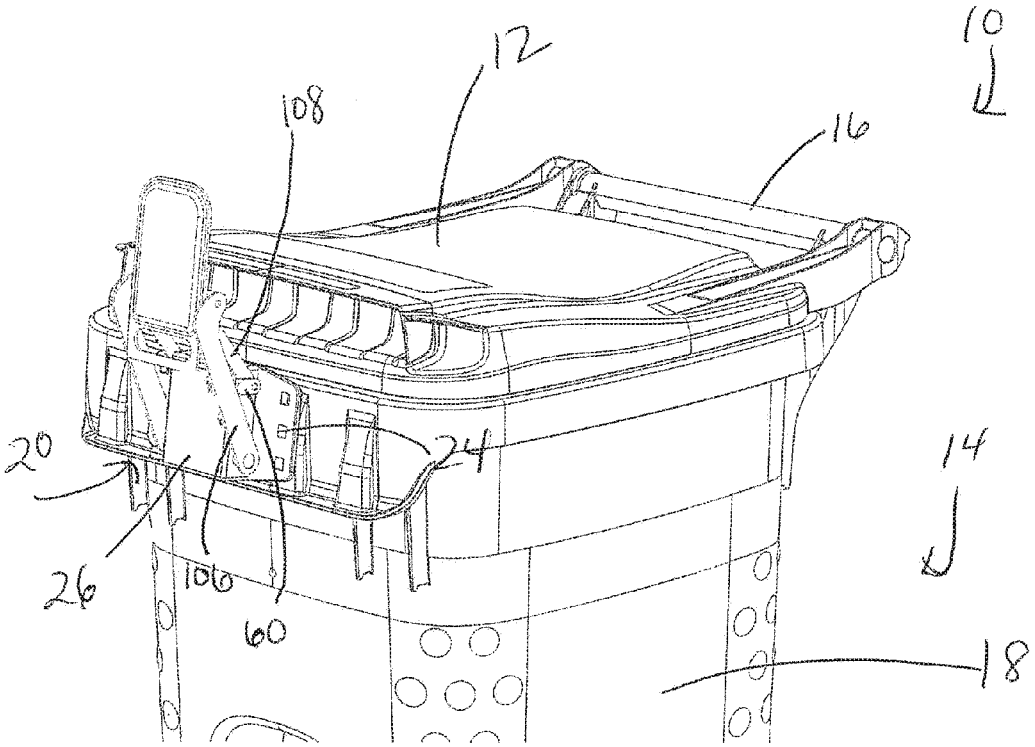
FIG. 10 is a fragmentary perspective view of a container with the locking device in a second position according to another exemplary embodiment of the present invention.
Figure 11:
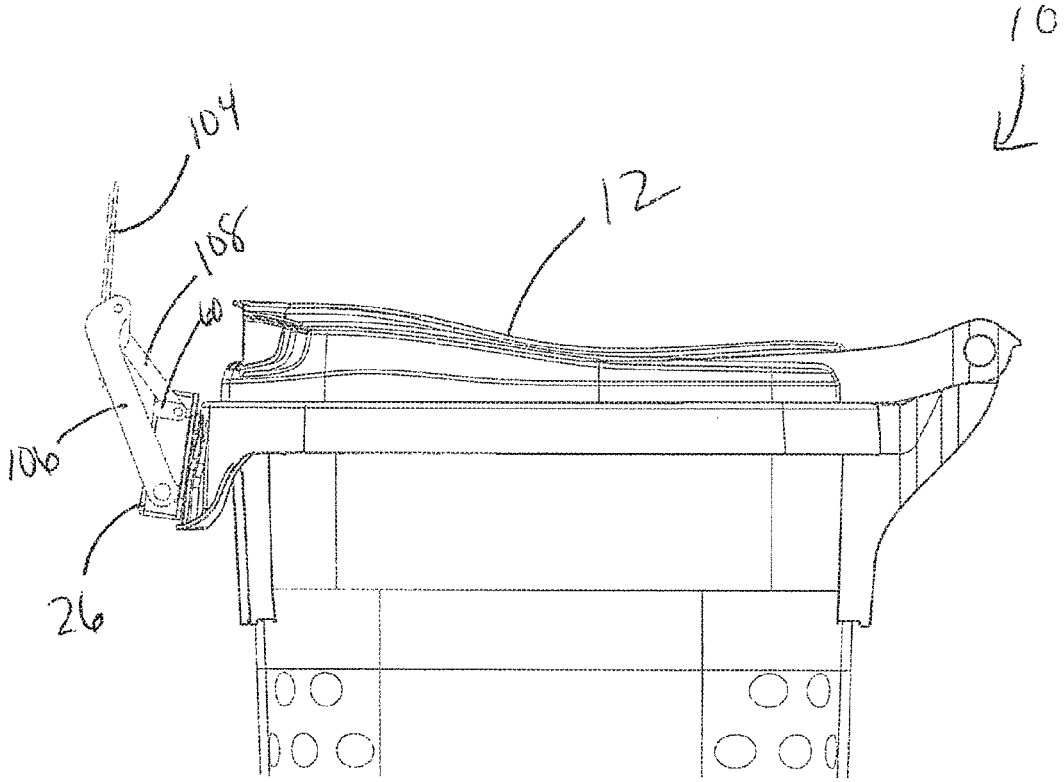
FIG. 11 is a fragmentary elevational view of the locking device in the second position according to another exemplary embodiment of the present invention.
Figure 12:
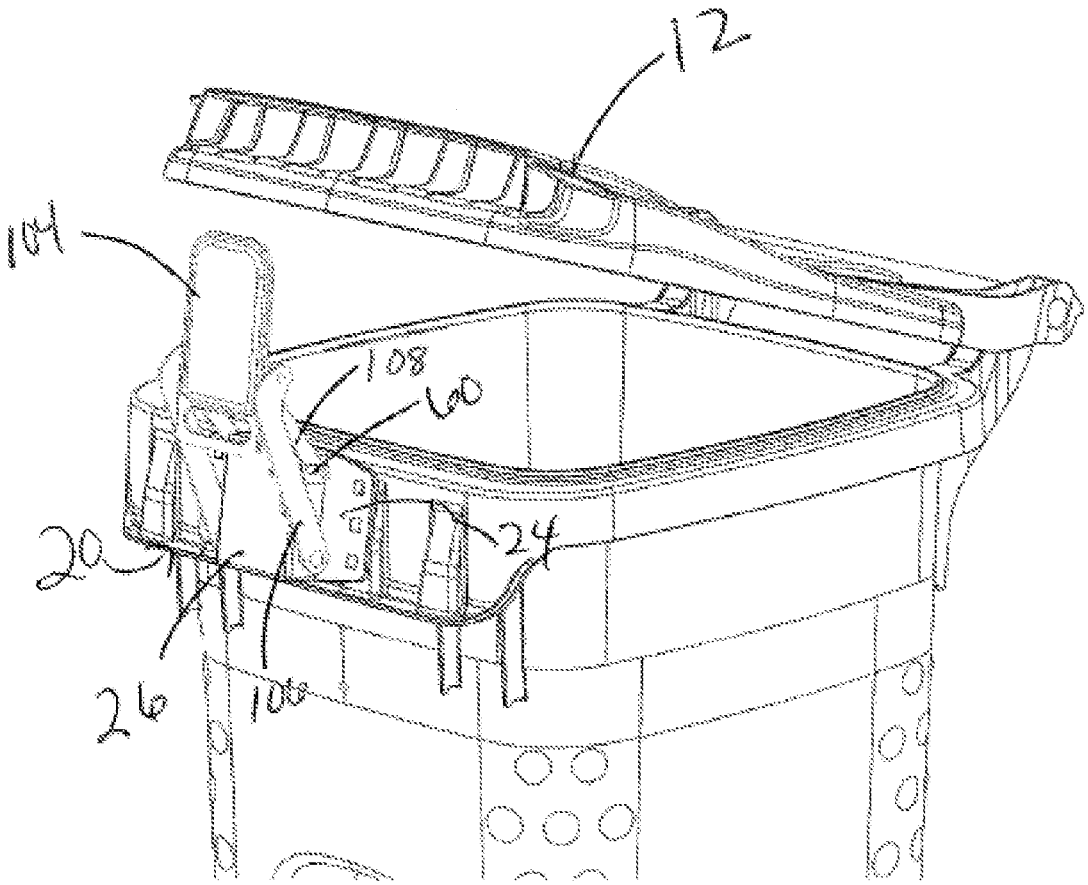
FIG. 12 is a fragmentary perspective view of a container with the locking device in a third position according to another exemplary embodiment of the present invention.
Figure 13:
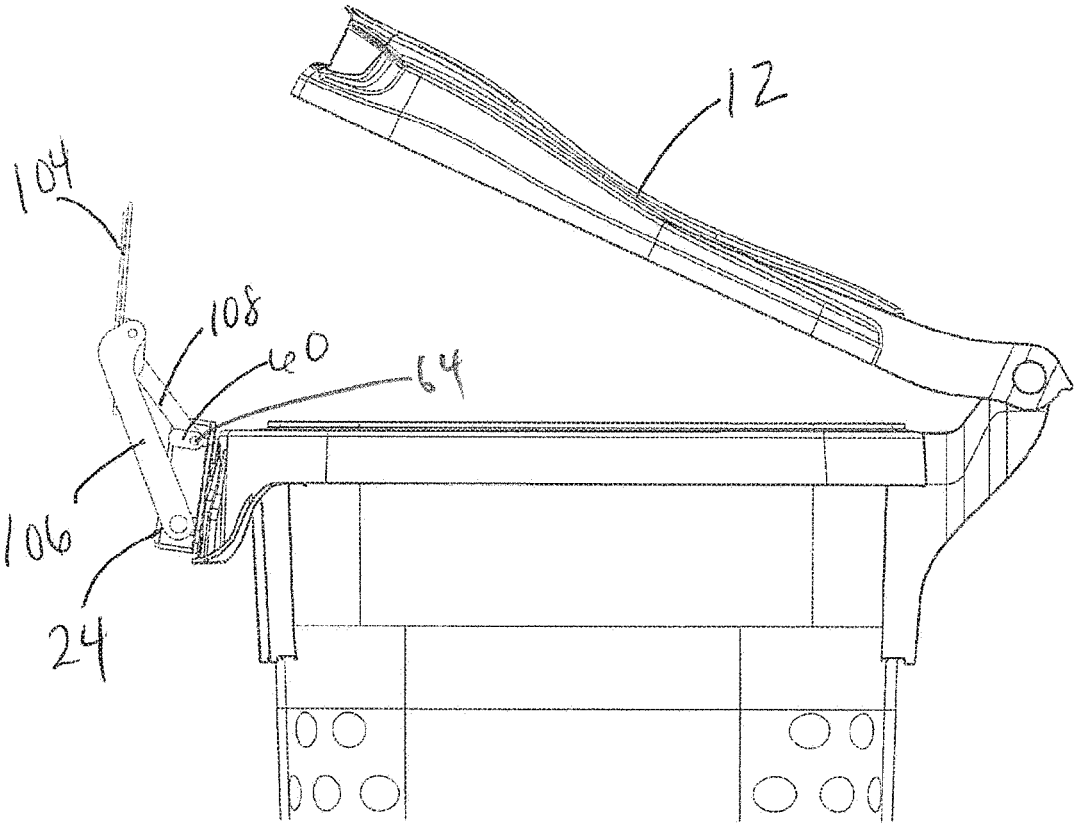
FIG. 13 is a fragmentary elevational view of the locking device in the third position according to another exemplary embodiment of the present invention.
Figure 14:
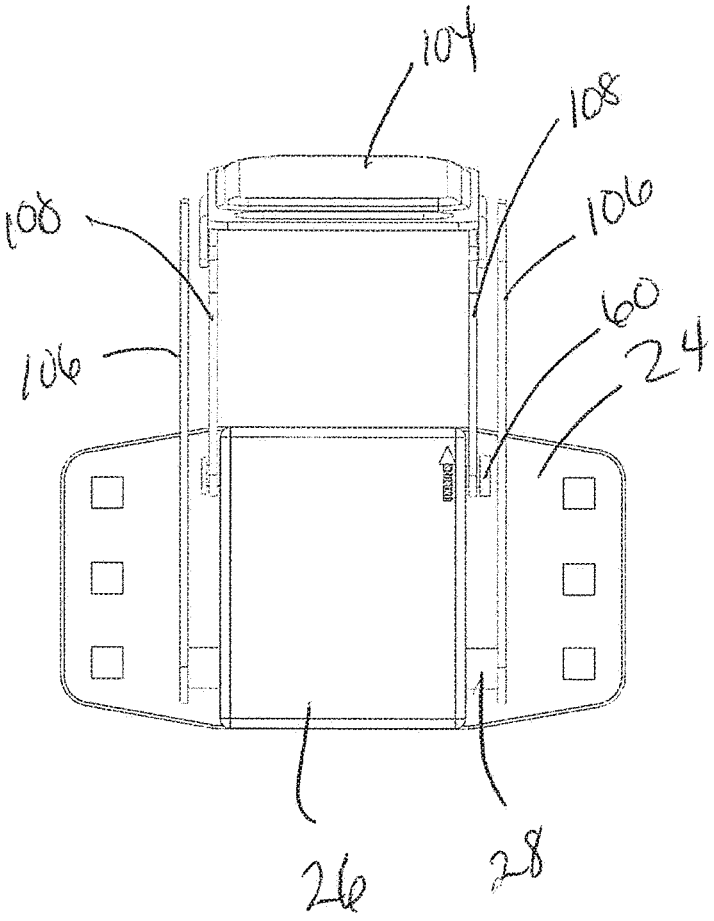
FIG. 14 is a front perspective view of the locking device according to another exemplary embodiment of the present invention.

In operation, when the container 10 is in an upright position and the locking device 20 is in the locked position, the locking plate 104 is located over the top surface of the lid 12 of the container 10, as illustrated in FIG. 9, and prevents the lid 12 from opening. In order to gain access to the containment body 14, a force is applied to the paddle actuation device lever 60 causing the planar member 62 to interact with the first paddle 32 and disengage the first paddle 32 from the first sloping surface 70, as previously described above. After the first paddle 32 is disengaged from the first sloping surface 70, the locking plate 104 can translate from a horizontal position to a vertical position, as illustrated in FIGS. 10 and 11. In addition, the second locking shaft 108 is free to extend away from the containment body 14 and the first locking shaft 106 causes the rotatable shaft 28 and cam 30 to rotate within the locking device housing 26, as previously described above. When the locking plate 104 is in a vertical position and the first locking shaft 106 and the second locking shaft 108 cause the locking plate 104 to be spaced away from the containment body 14, the locking device 20, specifically, the locking plate 104, is positioned such that no contamination of the locking device occurs when the contents of the container 10 are removed. The moment of inertia of the locking plate 104 is different from the rest of the locking arm 102 due to the first locking shaft 106 and the second locking shaft 108 being pivotably mounted to the locking plate 104.

Figure 16:
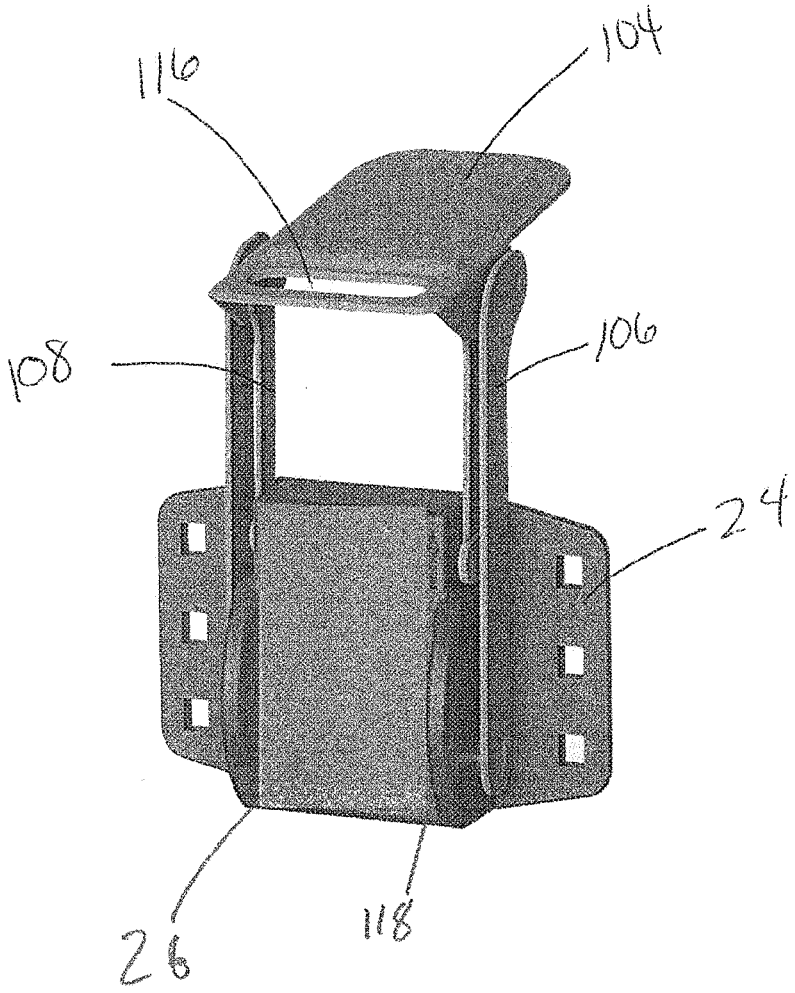
FIG. 16 is a front perspective view of a locking device according to another exemplary embodiment of the present invention.

In another exemplary embodiment, as best illustrated in FIG. 16, the locking device 20 can further include spacing members 118, which may act as bumpers to protect the locking device 20 from impact. The spacing members 118 extend from either side of the locking device housing 26. While spacing members 118 are illustrated as having a curved shape, one of ordinary skill in the art would recognize that the spacing members 118 can have any shape. The spacing members 118 can be made of the same material as the locking device housing 26 or a different material from the locking device housing 26. The spacing members 118 can be configured to provide a predetermined space between the locking device 20 and a content removal device such as an automatic arm on a refuse truck.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A locking device, comprising:

a. a locking block movable between a locked position and an unlocked position, the unlocked position allows the lock to be unlocked and the locked position keeps the lock locked; and b. first paddle having opposing first and second ends, the first end is mounted on a first hinge and the second end is detachably mounted on an attachment surface, so that when the second end is detached from the surface, the second end is positionable to block the locking block from moving to the unlocked position.

2. The locking device of claim 1, further comprising:

a locking arm having one end coupled to a rotatable shaft and being moveable between an opened position and a closed position; and a cam coupled to the rotatable shaft, wherein the cam is configured to rotate with the shaft, and wherein when locking arm is in the opened position, the cam urges the locking block to the unlocked position.

3. The locking device of claim 2, wherein the locking block has a channel, the attachment surface, and a first sloped surface opposing the attachment surface, and a second sloped surface spaced from the first sloped surface, when the first paddle is attached to the attachment surface, the first paddle is aligned with the channel; and when the first paddle is detached from the attachment surface, the first paddle is positionable to be in contact with the first sloped surface to prevent the locking block, from moving to the unlocked position.

4. The locking device of claim 3, further comprising a second paddle having opposing first and second ends, the first end is mounted on a second hinge and the second end is positionable to aligned with the channel or to be in contact with the second sloped surface.

5. The locking device of claim 4, wherein the second end of the second paddle is in contact with the second sloped surface when the locking device is in an upright position and the locking arm is in the closed position.

6. The locking device of claim 5, further comprising a paddle actuation device having a lever coupled to a planar member, wherein the planar member of the paddle actuation device is configured to place the first paddle in alignment with the channel of the locking block, when a force is applied to the lever of the paddle actuation device.

7. The locking device of claim 6, further comprising a blocking device having a cavity formed in a lower surface of the blocking device, wherein the cavity is configured to receive a stoppage device; and wherein the locking block further comprises a blocking device compartment cooperating with the cavity of the blocking device to contain the stoppage device.

8. The locking device of claim 7, wherein the stoppage device is a ball.

9. The locking device of claim 7, wherein the stoppage device is positionable in a first position when the locking device is upright and the locking, block is in the locked position, in a second position and in a third position when the locking device is on its side, in the second and third positions, the stoppage device blocks the locking block from moving to the unlocked position.

10. The locking device of claim 1, wherein the detachable mount of the second end of the first paddle to the attachment surface is magnetic.

11. A waster container comprising a containment body, a lid pivotally mounted to the containment body, and the locking device of claim 1 mounted on a wall of the containment body.

12. The waste container of claim 11, wherein the locking device further comprises a locking arm having one end coupled to a rotatable shaft and is moveable between an opened position and a closed position, wherein the locking arm is coupled to a rotatable shaft and is moveable between an opened position and a closed position, the locking arm blocks the lid from lifting away from the containment body in the closed position and allows the lid to lift away from the containment hod in the opened position; and a cam coupled to the rotatable shaft, wherein the cam is configured to rotate with the shaft, and wherein when locking arm is in the opened position, the cam urges the locking block to the unlocked position.

13. The waste container of claim 12, wherein the locking block has a channel, the attachment surface, and a first sloped surface opposing the attachment surface, and a second sloped surface spaced from the first sloped surface, when the first paddle is attached to the attachment surface, the first paddle is aligned with the channel, and when the first paddle is detached from the attachment surface, the first paddle is positionable to be in contact with the first sloped surface to prevent the locking block from moving to the unlocked position.

14. The waste container of claim 13, wherein the locking device further comprises a second paddle having opposing first end and second end, the first end is mounted on a second hinge and the second end is positionable to aligned with the channel or to be in contact with the second sloped surface.

15. The waste container of claim 14, wherein the second end of the second paddle is in contact with the second sloped surface when the locking device is in an upright position and the locking arm is in the closed position.

16. The waste container of claim 15, wherein the locking device further comprises a paddle actuation device having a lever coupled to a planar member, wherein the planar member of the paddle actuation device is configured to place the first paddle in alignment with the channel of the locking block when a force is applied to the lever of the paddle actuation device.

17. The waste container of claim 16, wherein the locking devices further comprises a blocking device having a cavity formed in a lower surface of the blocking device, the cavity is configured to receive a stoppage device; and wherein the locking block further comprises a blocking device compartment cooperating with the cavity of the blocking device to contain the stoppage device.

18. The waste container of claim 17, wherein the stoppage device is a ball.

19. The waste container of claim 17, wherein the stoppage device is positionable in a first position when the locking device is upright and the locking block is in the locked position, in a second position and in a third position when the locking device is on its side, in the second and third positions, the stoppage device blocks the locking block from moving to the unlocked position.

20. A method for making a waste container comprising the steps of a. providing a waste container containing a containment body and a lid pivotally mounted to the containment body; and b. mounting the locking device of claim 1 on a wall of the containment body.

* * * * *